US006110367A

United States Patent [19]

Jensen et al.

[11] Patent Number: 6,110,367

[45] Date of Patent: Aug. 29, 2000

[54] CLOSED DEVICE FOR TREATMENT OF DRILLING FLUIDS AND CUTTINGS

[75] Inventors: Ole Dagfinn Jensen, Marstad; Oystein Kalvenes, Bergen, both of Norway

[73] Assignee: Mercur Subsea Products ASA, Harstad, Norway

[21] Appl. No.: 09/355,301

[22] PCT Filed: Nov. 27, 1998

[86] PCT No.: PCT/NO98/00350

§ 371 Date: Jul. 27, 1999

§ 102(e) Date: Jul. 27, 1999

[87] PCT Pub. No.: WO99/28591

PCT Pub. Date: Jun. 10, 1999

[30] Foreign Application Priority Data

Nov. 27, 1997 [NO] Norway ..... 19975452

[51] Int. Cl.[7] ..... E21B 21/06; B01D 36/00

[52] U.S. Cl. ..... 210/297; 210/188; 210/258; 210/259; 210/402; 210/403; 210/406; 175/66; 175/206; 209/17

[58] Field of Search ..... 210/403, 402, 210/784, 297, 406, 188, 259, 258; 175/206, 66; 209/288, 297, 298, 295, 17

[56] References Cited

U.S. PATENT DOCUMENTS

| | | |
|---|---|---|
| 4,639,258 | 1/1987 | Schellstede et al. . |
| 4,649,655 | 3/1987 | Witten . |
| 4,747,961 | 5/1988 | Beer et al. . |
| 5,454,957 | 10/1995 | Roff . |
| 5,582,727 | 12/1996 | Foster . |

FOREIGN PATENT DOCUMENTS

| | | |
|---|---|---|
| 89/09091 | 10/1989 | WIPO . |

*Primary Examiner*—Thomas M. Lithgow
*Attorney, Agent, or Firm*—Hedman, Gibson & Costigan, P.C.

[57] ABSTRACT

The invention relates to a device for treatment of drilling mud and cuttings, comprising a screen, a centrifuge (10), a degassing system (6), a discharge system directing the drilling mud back to the active drilling mud system (13, 14), a transport system (17) transporting the cuttings. The screen is a rotating drum (3), and the drum is situated in a mainly enclosed housing (1) with the housing being connected to a vacuum suction system. The solid material discharge from the rotating drum (3) is connected to a downstream centrifuge (10), by a mainly enclosed pipe system (9). A weighing cell (16) for cuttings is connected to the centrifuge (10).

8 Claims, 1 Drawing Sheet

CLOSED DEVICE FOR TREATMENT OF DRILLING FLUIDS AND CUTTINGS

FIELD OF THE INVENTION

The present invention relates to a device of the kind indicated in the introduction of claim 1.

BACKGROUND OF THE INVENTION

It is of great interest to recover valuable components that can be recycled by treatment and cleaning of drilling mud, such as the original drilling mud, including particular components added to this in order to reach desired characteristics, said components also being of particulate form.

In addition, environmental considerations and labor conditions have recently gained increasing interest. It is known that the oil industry is responsible for considerable releases of environmentally hazardous materials, and that workers, e.g. on the platforms, have been exposed to considerable amounts of health-hazardous substances.

Norwegian Patent no. 172568 describes a method and device for treatment of returned drilling mud during oil and gas drilling. Included is a degassing step, a vibrating screen shaker, and one or more steps of separating coarse to fine cuttings from drilling mud, as well as a transport system for transporting the cuttings. One of the features characterizing this method is the use of a so called screw classifier as a first separating step. A disadvantage of this system and other similar systems using conventional vibrating screen shakers is that the cuttings, e.g. if the crown bit penetrates particularly difficult formations, clogs the screen shaker. In this case the screen must be manually scraped and de-clogged. Of this reason, the screen shaker system must be partly open, in order to give access for the workers with their tools. In this case, the workers are also exposed to chemicals and gasses present in the drilling mud and cuttings.

In systems known today, the separated cuttings contain too much drilling mud, resulting in a relatively large loss of active drilling mud, leading to considerable economic loss.

OBJECTS OF THE INVENTION

It is an object of the invention to provide a device that to a large extent avoids clogging of the screen.

It is an other object of the invention to provide a device protecting the workers and environment from gasses to a larger extent than before.

It is a third object of the invention to increase the return of drilling mud from the cuttings.

SUMMARY OF THE INVENTION

These objects are reached by a device of the kind indicated in the characterizing clause of claim 1.

Since the screen does not clog, the necessity for a open system disappears, and it is possible to provide a closed degassing system protecting the environment and workers.

The invention is in the following described with reference to the enclosed FIG. 1.

DETAILED DESCRIPTION

Figure 1:
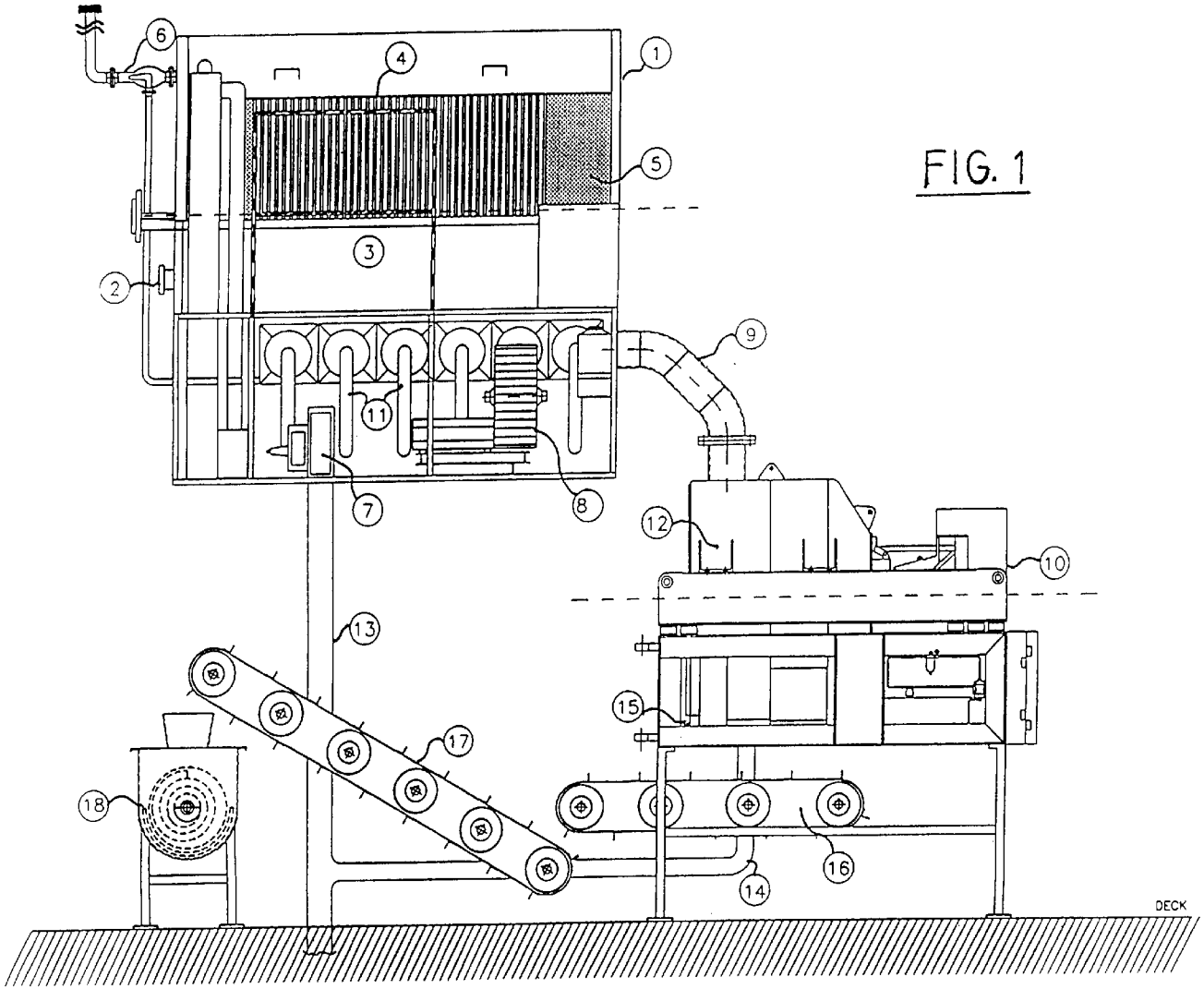

In FIG. 1 the drilling mud enters through the entrance pipe 2 to the screen, comprising a rotating drum 3, the axis of which is horizontal. The rotating drum is situated in a mainly closed housing 1. The walls of the drum 3 are perforated like a conventional screen, but instead of the screen vibrating in a mainly horizontal plane, the screen rotates around its own axis. This rotation avoids the clogging of said screen. Instead of the cuttings being laid down as a clogging layer above the screen, the cuttings do not get the opportunity to create a such clogging layer because it loosens from the drum in the upper portion of the rotational path of the drum.

A perforated wall is placed on the outside of the drum. A strainer material 4 covers the inside of this perforated wall 5. A vacuum fan 8 outside the strainer material and perforated wall 5 creates a vacuum on the outside of the rotating drum 3, and contributes to separate the clean drilling mud from the cuttings. The separated drilling mud is led back to the active system through the discharge pipe 13. In addition the vacuum pulls spill gasses out of the drilling mud and cuttings. The vacuum is controlled by vacuum valves 11.

The discharge from the vacuum pump is connected to the propulsion inlet of a ejector pump 6. The suction inlet of the ejector pump 6 is connected to the upper portion of the housing 1 and contributes to pulling the gas out of said housing. The evacuation of gas takes place through a pipe system from the ejector pump 6, to a suitable place on the drilling vessel, where the collected gas undergoes post treatment or is released.

The rotating drum 3 may on the inside be provided with a screw, further transporting the cuttings. The cuttings are little by little transported to the discharge of the partly enclosed housing 1, containing the rotating drum 3, and are led trough a pipe 9 to a vibrating centrifuge 10.

The housing 1 and the enclosure the vibrating centrifuge is situated in, are connected with each other by the pipe 9. Since the discharge of the vibrating centrifuge is open, the vacuum in the housing 1 will cause air to be sucked into the discharge of the vibrating centrifuge 10 and further through the pipe 9 into the housing 1. This ensures that the gas escaping the cuttings during treatment is collected and does not escape the system comprising the rotating drum 3 and the vibrating centrifuge 10. The drilling mud is separated from the cuttings by means of the centrifugal forces.

The separated drilling mud is directed back to the active system trough the discharge pipe 14. The remaining amount of drilling mud in the cuttings is in the range 3 to 6 volume percentage, considered to be very little by the person skilled in the art.

The mainly dry cuttings are feed out of a feeder 1and down onto a weighing cell 16, by which the cuttings are weighted. The cuttings are transported by means of a conveyor 17 to the conveyor worm 18, by which the cuttings are led to a suitable location on the drilling vessel and optionally treated before depositing or injection.

What is claimed is:

1. A device for the treatment of drilling mud and cuttings, comprising a screen receiving used drilling mud and separating a screened drilling mud from a cuttings discharge, a centrifuge (10) positioned to receive the cuttings discharge from the screen and separate a further portion of drilling mud from cuttings, a degassing system (6) operatively associated with said screen, a discharge system receiving the drilling mud from the screen and centrifuge (10) and directing the drilling mud back to an active drilling mud system (13, 14), and a transport system (17) receiving the cuttings from the centrifuge (10) for transporting the cuttings, characterized by the screen comprising a rotating drum (3), said drum being situated in a mainly enclosed housing (1), said housing being connected to a vacuum suction system.

2. The device according to claim 1 wherein the cuttings discharge from the rotating drum (3) is connected to a downstream centrifuge (10) by means of a mainly enclosed pipe system (9).

3. The device according to claim 1 further comprising a weighting cell (16) for weighing the cuttings received from the centrifuge (10).

4. The device according to claim 1 wherein the vacuum suction system comprises a vacuum pump (8).

5. The device according to claim 4 wherein the lower portion of the drum (3) is operatively associated with the vacuum pump (8), for suction of gas and/or drilling mud from the drum (3).

6. The device according to claim 4 wherein the discharge of the vacuum pump (8) is connected to the propulsion inlet of an ejector pump associated with the housing (1).

7. The device according to claim 5 wherein a lower portion of the housing (1) is associated with a gear pump (7) for transport of collected screened drilling mud.

8. The device according to claim 5 further comprising vacuum valves (11) associated with the vacuum pump (8).

* * * * *